US008037726B2

(12) United States Patent
Faina

(10) Patent No.: US 8,037,726 B2
(45) Date of Patent: Oct. 18, 2011

(54) METHOD FOR BENDING TUBULAR ARTICLES WITH A RELATIVE RATIO OF THE BENDING RADIUS AND THE OUTER DIAMETER OF THE FINISHED PIPE WHICH IS LESS THAN 3

(75) Inventor: Urbano Faina, Comate d'Adda (IT)

(73) Assignee: IBF S.p.A., Cornate D'Adda (Frazione Colnago) (IT)

( * ) Notice: Subject to any disclaimer, the term of this patent is extended or adjusted under 35 U.S.C. 154(b) by 452 days.

(21) Appl. No.: 12/336,790

(22) Filed: Dec. 17, 2008

(65) Prior Publication Data

US 2009/0158806 A1 Jun. 25, 2009

(30) Foreign Application Priority Data

Dec. 19, 2007 (IT) ..... MI07A02372

(51) Int. Cl.
*B21D 9/08* (2006.01)
*B21D 5/02* (2006.01)

(52) U.S. Cl. ..... 72/58; 72/62; 72/370.22; 72/342.94; 72/342.96; 29/421.1

(58) Field of Classification Search ..... 72/58, 60, 72/61, 62, 369, 370.22, 342.94, 342.96; 29/421.1
See application file for complete search history.

(56) References Cited

U.S. PATENT DOCUMENTS 1,962,510 A * 6/1934 Kellogg ..... 72/345
2,466,877 A 4/1949 Cross ..... 153/48
2,957,229 A 10/1960 Beatty ..... 29/157
3,934,450 A * 1/1976 Reed ..... 72/383
4,596,128 A * 6/1986 Ringersma et al. ..... 72/128
4,841,760 A * 6/1989 Ferguson ..... 72/133
4,854,150 A * 8/1989 Brown et al. ..... 72/369

(Continued)

FOREIGN PATENT DOCUMENTS

DE 32 47 200 A1 7/1984

(Continued)

OTHER PUBLICATIONS

Patent Abstract of Japan for JP 57-47530, published Mar. 18, 1982.

(Continued)

*Primary Examiner* — David Jones
(74) *Attorney, Agent, or Firm* — Mintz, Levin, Cohn, Ferris, Glovsky and Popeo, P.C.

(57) ABSTRACT

Method for bending tubular articles with a relative ratio of the bending radius (R) and the outer diameter (D) of the finished pipe which is less than 3, comprising the following steps: forging an article made of material with a predefined composition depending on the final use and with a predefined length (L) in the longitudinal direction and an outer diameter (D); providing a die having an asymmetrical bottom die half with seat for the pipe; and a top die half with punch asymmetrically arranged in the longitudinal direction (X-X) with respect to the vertical center axis of the die; heating the article in an oven to the required temperature for forging depending on the specific composition of the material; positioning the article inside the bottom die half in the longitudinal direction; closing of the two die halves so as to start bending of the article; opening the die; and extracting the bent article.

11 Claims, 5 Drawing Sheets

U.S. PATENT DOCUMENTS

| | | | | |
|---|---|---|---|---|
| 5,974,854 | A * | 11/1999 | Tseng | 72/466 |
| 7,140,225 | B2 * | 11/2006 | Takahashi et al. | 72/369 |
| 7,464,572 | B2 * | 12/2008 | Miyanaga et al. | 72/58 |

FOREIGN PATENT DOCUMENTS

| | | |
|---|---|---|
| GB | 2 062 506 A | 5/1981 |
| JP | 57-47530 | 3/1982 |
| JP | 57-152318 | 9/1982 |
| JP | 62-54526 | 3/1987 |

OTHER PUBLICATIONS

Patent Abstract of Japan for JP 57-152318, published Sep. 20, 1982.
Patent Abstract of Japan for JP 62-54526, published Mar. 10, 1987.

* cited by examiner

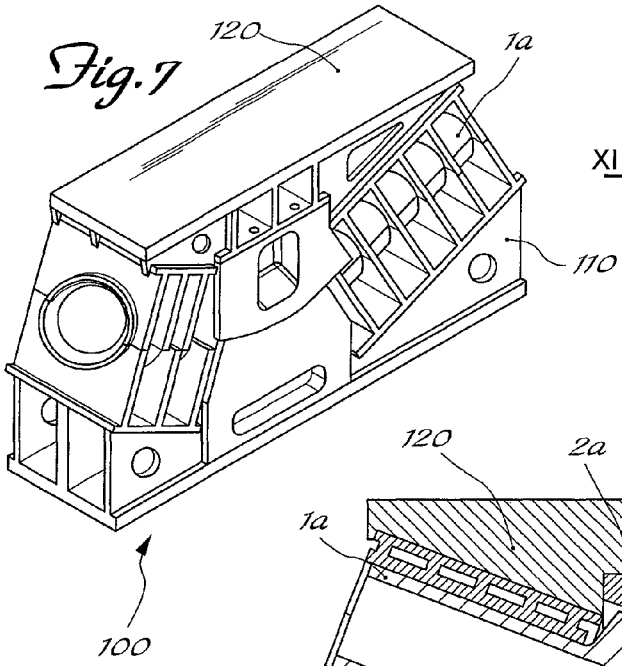
Fig.7
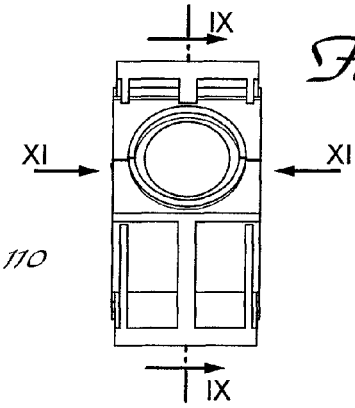
Fig.8
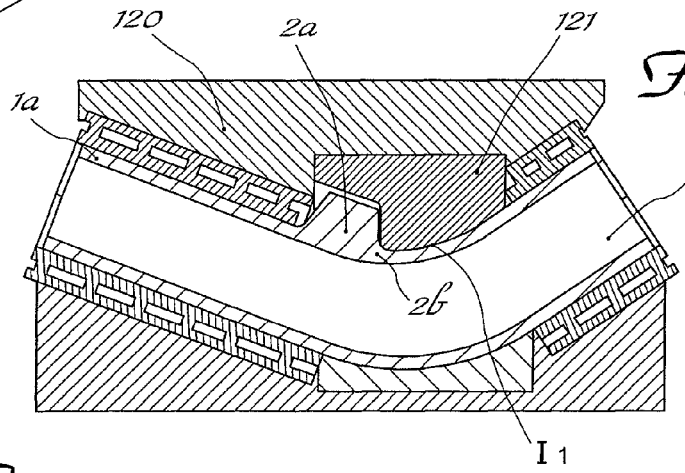
Fig.9
Fig.10
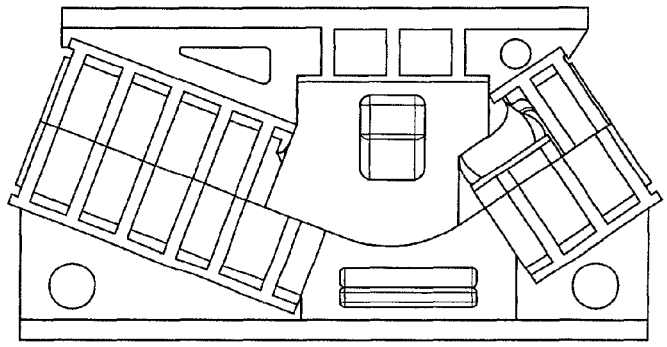
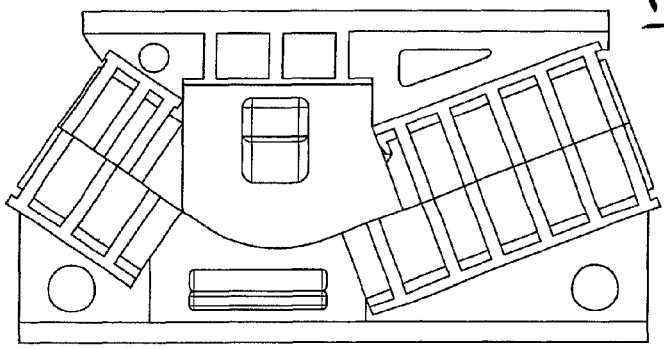
Fig.11

METHOD FOR BENDING TUBULAR ARTICLES WITH A RELATIVE RATIO OF THE BENDING RADIUS AND THE OUTER DIAMETER OF THE FINISHED PIPE WHICH IS LESS THAN 3

TECHNICAL FIELD OF THE INVENTION

The present invention relates to a method and a die for bending tubular elements.

DESCRIPTION OF THE PRIOR ART

It is known in the technical sector relating to the manufacture of large-size tubular piping which is normally made by means of forging that there exists the need to obtain curved sections by means of bending of the pipe.

Although the bending methods performed for example using bending machines are per se conventional, these methods however are not suitable in the particular case where it is required to bend pipes which have relative ratios of the bending radius R and the outer diameter D of the pipe with values less than 3.

It is also known that this piping must have connecting branches extending in transverse—i.e. usually radial—directions and, particularly in the case of piping used for high-risk applications, such as nuclear power stations, these branches should not be welded to the respective pipe section after bending, but must be formed integrally therewith during forging of the pipe so as to ensure continuity of the piping and therefore avoid the risk of leakages of dangerous material.

The presence of these transverse branch extensions integral with the pipe means, however, that conventional bending machines cannot be used and in particular makes it difficult to perform bending of the pipe with the degree of precision required by the specific applications, the bending not being able to performed using normal known methods particularly in the case where the base of one or more of these branches is adjacent to the initial section of curvature of a curved section, making it particularly difficult to perform both forging of the article and subsequent bending.

SUMMARY

The technical problem which is posed, therefore, is to provide a method and an associated die for bending pipes for piping having relative ratios R/D of the bending radius R and the outer diameter D of the pipe with values less than 3.

In connection with this problem it is also desirable that the die and method should be able to allow bending with the necessary tolerances also in the case where radial branches integral with the pipe are present during bending.

These results can be achieved according to the present invention by a method according to the characteristic features and a die according to the characteristic features provided in the description and the claims.

BRIEF DESCRIPTION OF THE FIGURES

Further details may be obtained from the following description of a non-limiting example of embodiment of the subject of the present invention provided with reference to the accompanying drawings in which:

FIG. 7 shows a perspective view of the assembly according to FIG. 1 during the final bending stage;

FIG. 8 shows a front view of the assembly according to FIG. 7;

FIG. 9 shows a cross-section along the plane indicated by IX-IX in FIG. 8;

FIG. 10 shows a side view of the assembly according to FIG. 7 in the direction of the arrow X shown in FIG. 8;

FIG. 11 shows a side view of the assembly according to FIG. 7 in the direction of the arrow XI shown in FIG. 8;

DETAILED DESCRIPTION

Figure 1:
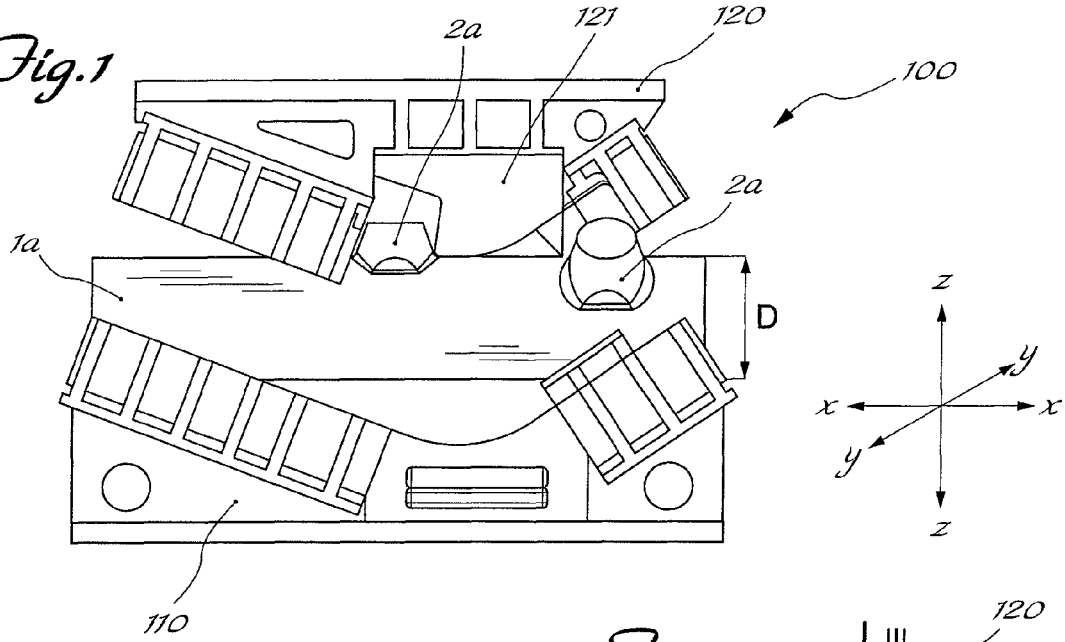
FIG. 1 shows a side view of a pipe with radial branches, inserted inside a die according to the present invention.
Figure 2:
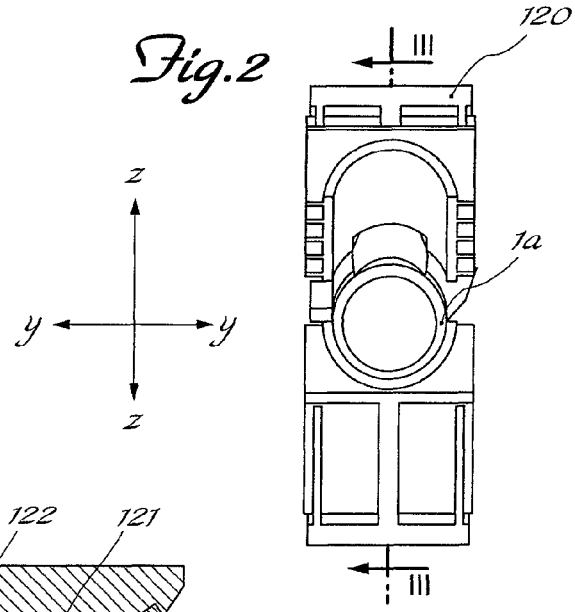
FIG. 2 shows a front view of the assembly according to FIG. 1.

As shown in FIG. 1 and assuming for the sole sake of convenience of description and without limiting the description, a set of three reference axes in a longitudinal direction X-X, transverse direction Y-Y and vertical direction Z-Z, respectively, the pipe 1*a* to be bent extends in the longitudinal direction X-X and has an outer diameter D.

The straight article 1*a* used as the basic part for the method according to the present invention is obtained by forging a bloom of the material required and will have a form (produced at the steelworks), diameters, thicknesses and lengths which are suitable for obtaining the finished part with the required dimensions after forming/forging according to the present invention.

The forged straight article (such as a forged pipe) 1*a* also has bosses 2*a* of material which project radially in specific zones and from which, using the methods described below, the integral branches 2 projecting radially from the surface of the finished pipe 1 will be obtained.

Figure 3:
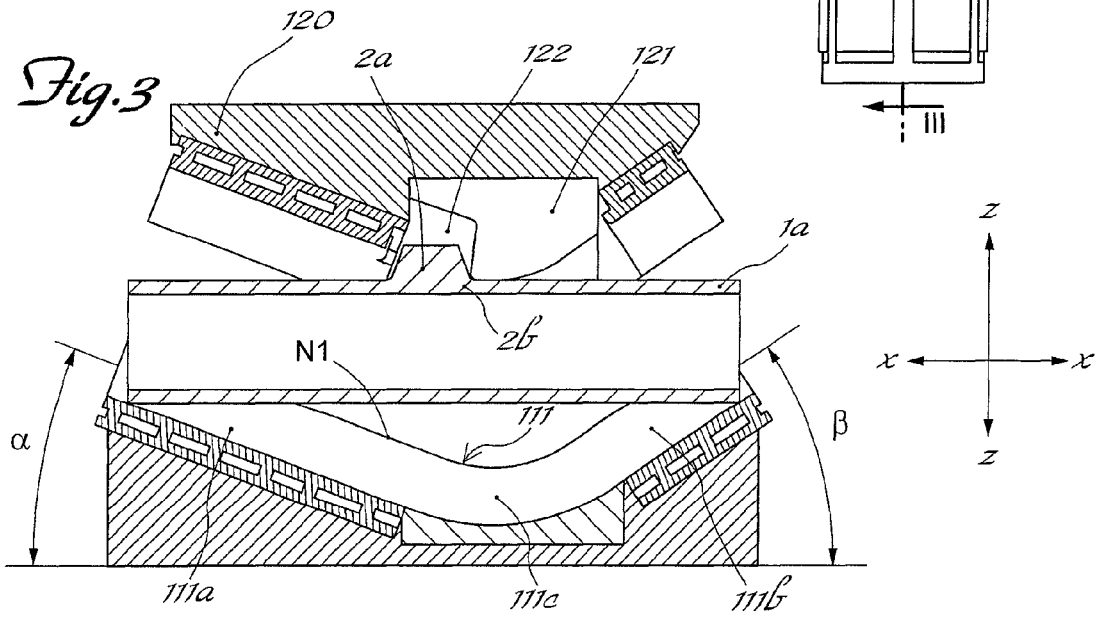
FIG. 3 shows a schematic cross-section along the plane indicated by III-III in FIG. 2.
Figure 4:
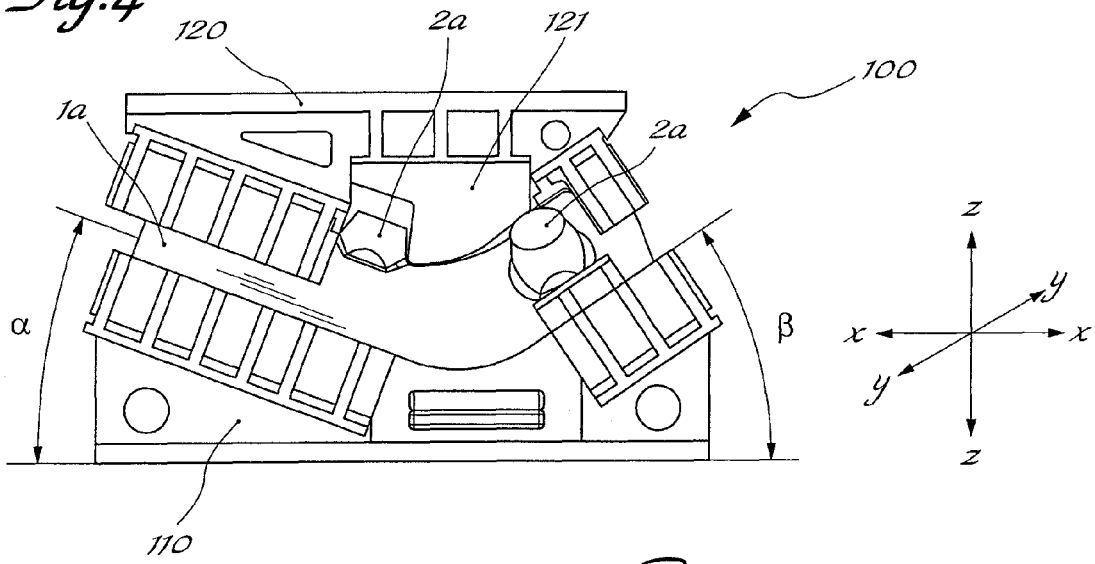
FIG. 4 shows a side view of the assembly according to FIG. 1 during the first bending stage.
Figure 5:
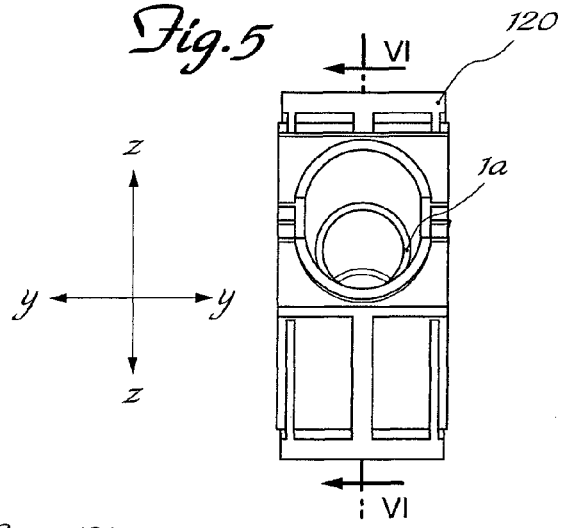
FIG. 5 shows a front view of the assembly according to FIG. 4.
Figure 6:
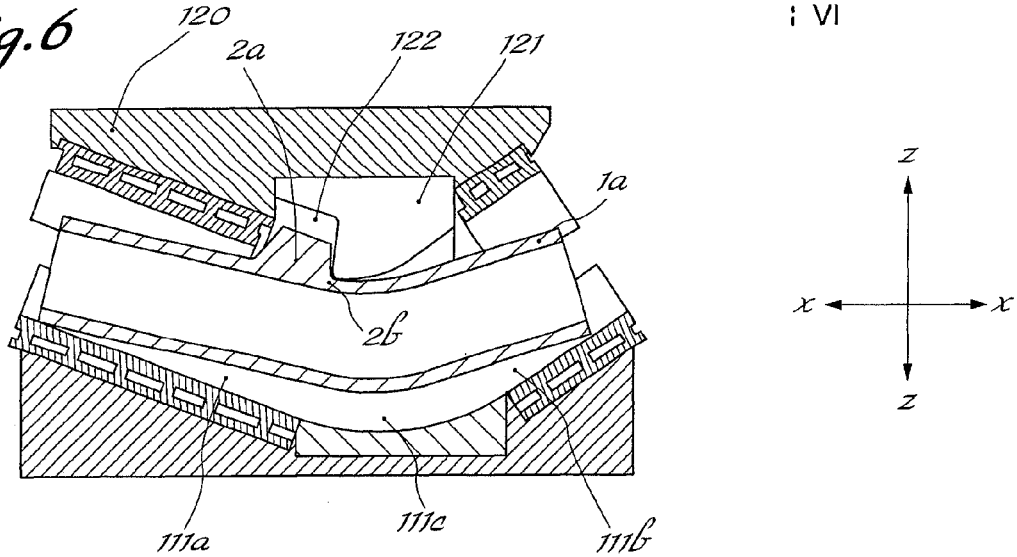
FIG. 6 shows a schematic view along the plane indicated by VI-VI in FIG. 5.
Figure 12A:
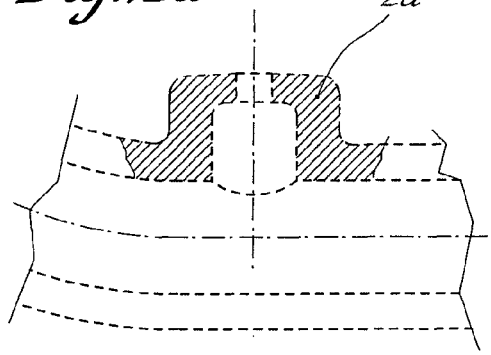
FIGS. 12*a*-12*d* shows schematic cross-sections along vertical planes of the pipe branch finishing stages.
Figure 12B:
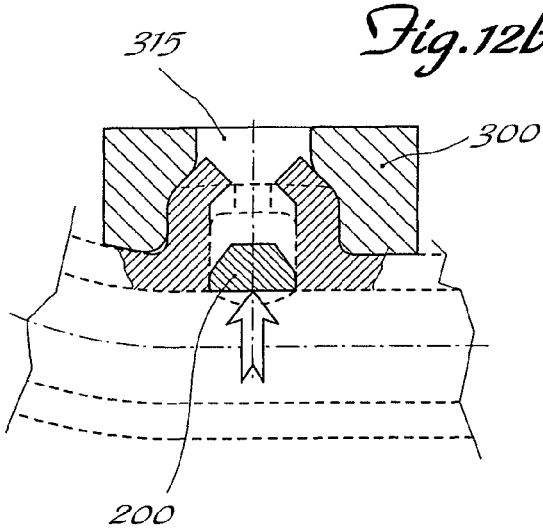
Figure 12C:
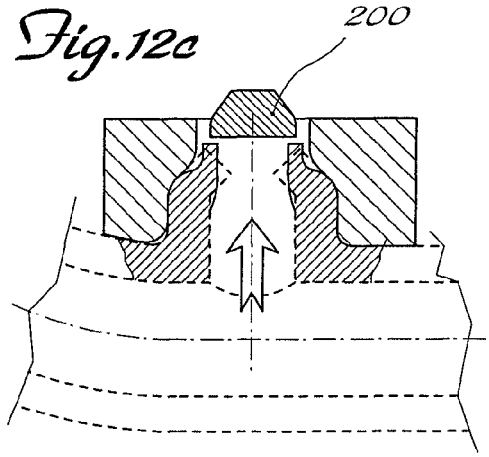
Figure 12D:
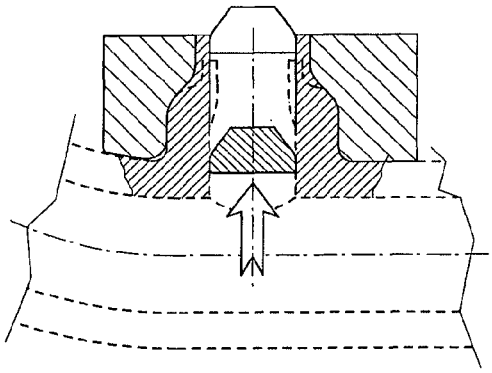

The forged straight article 1*a* is inserted inside an asymmetrical vertical die 100 formed by a bottom die half 110 and a top die half 120; the bottom die half (FIG. 3) has a seat 111 for the finished pipe 1, comprising a first straight section 111*a*, forming a first angle $\alpha$ with the horizontal base surface, and a second straight section 111*b*, forming an angle $\beta$ with respect to the same base surface; the two straight sections are connected continuously by a suitable joining piece 111*c*.

The inner part of the curved top die half 120 has a form corresponding to the half curve which extends from the neutral axes N1 as far as the intrados I1 (FIG. 9) of the bent pipe 1.

If, as in the case shown, bosses 2*a* of material for forming the branches 2 are present, and said bosses 2*a* are arranged in the zones adjacent to the section to be bent, it is not possible to use a symmetrical bending process according to the conventional technique and maintain an active and reactive force along the same axis in the press, and it is instead necessary to perform asymmetrical bending.

For this purpose the top die half 120 has inside it a seat 122 suitably formed in the top die half 120 with dimensions corresponding to the dimensions of the boss 2*a* and a punch 121 asymmetrically arranged in the longitudinal direction X-X with respect to the vertical centre axis of the die so as to cause initial contact between the top die 120 and the forged straight article 1*a*, along a section adjacent to the base 2*b* of the boss 2*a* and cause initial bending of the curve in the vicinity of the latter.

Using the die described above it is possible to implement a method for bending tubular elements, comprising the following steps:

preparing a straight article (such as, a forged pipe) 1*a* made of material with a predefined composition depending on the final use and with a predefined length L in the longitudinal direction and outer diameter D;

said pipe may have at least one boss 2*a* with base 2*b* extending radially outwards;

preparing a die (100) comprising:

an asymmetrical bottom die half 110 with seat 111 for the article 1*a;* a top die half 120 with punch 121 asymmetrically arranged in the longitudinal direction X-X with respect to the vertical centre axis of the die;

and an optional seat 122 for receiving the boss 2*a*, if present;

heating in an oven to the required temperature for forging depending on the specific composition of the material;

ovalization of the longitudinal pipe section Lp corresponding to the section for bending by means of the press;

positioning the straight article 1*a* inside the bottom die half 110 in the longitudinal direction X-X so that the base 2*b* of the boss 2*a* is substantially aligned in the vertical direction Z-Z with the head of the upper punch 121;

bending of the article 1*a* by means of closing of the two die halves.

Although bending may be performed in a single step it is preferable to perform the final bending in several stages—preferably two or three stages—alternating with intermediate heating stages for restoring the initial forging temperature.

Should the die have a round cross-section it is possible to obtain a curved article already sized with a round cross-section; in practice it is preferred, however, to provide slight ovalization of the bending die so as to allow a subsequent sizing step by means of which more precise tolerances may be determined; in this case the oval form of the die will be such that the larger axis is perpendicular to the plane which contains the axis of the article bent by means of the bending operation;

machine-tool machining of the bent and cooled part so as to perform the finishing thereof to the final dimensions.

Should the bosses have a length sufficient for the purpose, it is possible to perform rough-machining, heat treatment and surface-finishing.

Where bosses 2*a* are present, as shown, should they have a length in the transverse direction Y-Y (radial direction) less than the required length for the final branch 2, further steps are required in the method as described below with reference to FIGS. 12*a* to 12*d:* boring the boss 2*a* in the radial direction;

localized heating of the zone to be deformed, up to the temperature necessary for plastic deformation;

multi-step extrusion by means of successive through-forcing of drift plugs 200 of increasing diameter until the external surface of the boss 2*a* makes contact with the internal surface of a suitably formed seat 315 in an external die 300;

drawing the material by means of through-forcing of drift plugs with a diameter greater than the internal diameter of the branch, the thickness of which is reduced and the length of which increased to the design dimension;

heat treatment required for use of the finished pipe;

machine-finishing;

surface finishing treatment (pickling, passivation and the like).

EXAMPLE

The accompanying drawings illustrate, purely by example, bending of a part performed during trial tests (FIGS. 13 and 14) on a pipe sample with a diameter D=515 mm and length $L_{11}$=2,848 mm which had a first boss with a height $h_{11}$ asymmetrically arranged at distances $L_{21}$=1171.6 e $L_{31}$=1676.3 from the opposite ends of the pipe.

Figure 13:
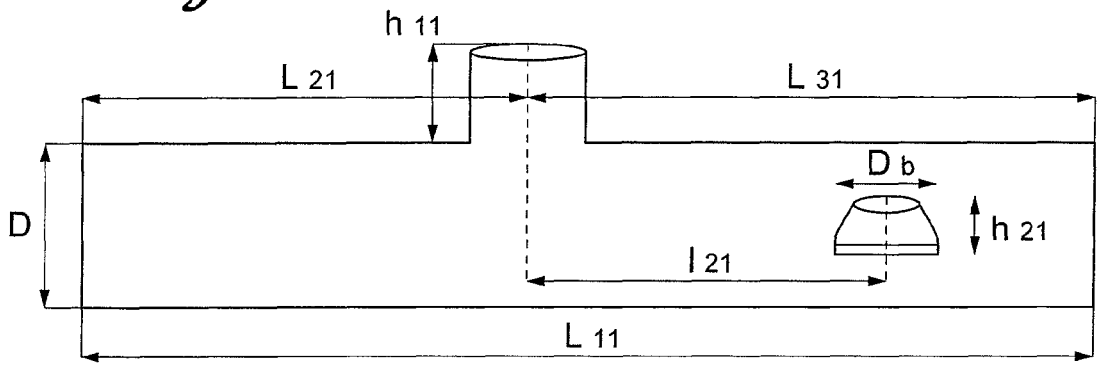
FIGS. 13-14 show side views of a practical example of application of the method according to the present invention.
Figure 14:
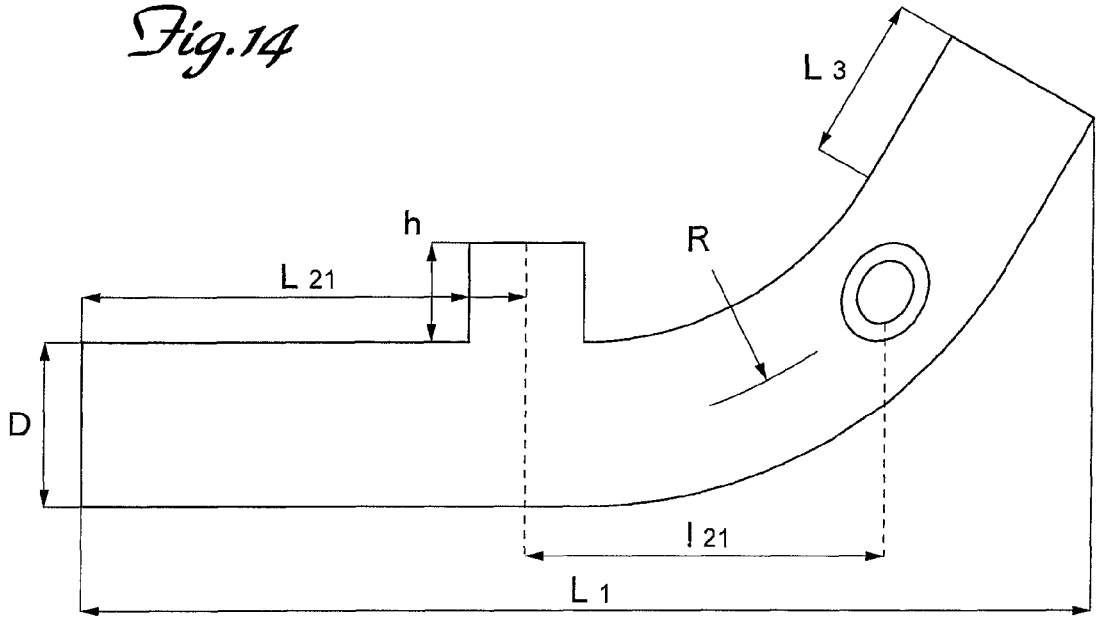

Said bosses had a height $h_{11}$=$h_{21}$=200.8 mm, diameter of the base $D_b$=377.8 and interaxial distance $L_{21}$=1014.5 mm (FIG. 13).

The pipe made of material 316L was treated with heating performed at T=950° C.

The finished and bent pipe had a length $L_1$=2640 mm, a first straight section with a length $L_{21}$=1014.5 mm, a second straight section $L_3$=460 mm, connected together by a joining piece with a radius of curvature R=735.08 mm about 1.5 times the outer diameter D of the pipe and bending angle=56°; the outer diameter D, after sizing, was between 497 and 502 mm, a first boss arranged in position $L_{21}$=1171.6 mm and a second boss arranged at a distance $l_{21}$=620 mm from the first boss; both bosses had a diameter of the base $D_b$=377 mm and height h=205 mm.

It is therefore clear how with the die and the method according to the invention it is possible to bend pipes using an industrial method which is repetitive and reliable also in the case of a relative ratio of the bending radius R and the outer diameter D of the pipe which is less than 3 and also form transverse branches integral with the pipe from radial bosses integral with the manufactured pipe at the time of bending.

The same method is also applicable in the particularly complex case of bending being started in a zone very close to the base of the branch, which case has not been solved by the prior art.

The invention claimed is:

1. Method for bending tubular articles with a relative ratio of the bending radius (R) and the outer diameter (D) of the finished article which is less than 3, comprising:

forging an article made of material with a predefined composition depending on the final use and with a predefined length in the longitudinal direction and an outer diameter (D);

providing a die comprising an asymmetrical bottom die half having a seat for the article and a top die half having a punch asymmetrically arranged in the longitudinal direction with respect to the vertical centre axis of the die;

heating the article to a required temperature for forging based on a specific composition of the material;

positioning the article inside the bottom die half in the longitudinal direction;

closing the top die half on to the bottom die half so as to start bending the article;

opening the die; and extracting the bent article.

2. Method according to claim 1, further comprising machine-tool machining the bent and cooled part to final dimensions thereof.

3. Method according to claim 1, further comprising ovalizating a section of the article corresponding to an area of bending before positioning of the article on the bottom die half.

4. Method according to claim 1, wherein bending is performed by a multi-step sequence.

5. Method according to claim 4, wherein before each bending operation the article is heated to forging temperature.

6. Method according to claim 1 for bending an article provided with at least one boss projecting radially along a longitudinal pipe section to be bent, comprising:

preparing a seat in the top die half, arranged adjacent to the punch for receiving the said boss;

positioning the straight article in the longitudinal direction X-X inside the bottom die half in a position such that the base of the boss is substantially aligned vertically with the head of the upper punch.

7. Method according to claim 6, further comprising:

boring the boss in the radial direction;

localized heating of a zone of the boss to be deformed, up to a temperature necessary for plastic deformation;

introducing the boss inside a suitably formed seat of an outer die;

using multi-step extrusion to force a plurality of drift plugs of increasing diameter through the boss until the outer surface of the boss makes contact with the inner surface of a suitably formed seat in an outer die; and drawing the boss by inserting drift plugs with a diameter greater than the internal diameter of the boss until predefined dimensions are achieved.

8. Method according to claim 7, further comprising:

heat treating at least a portion of the bent article;

machine-finishing at least a portion of the bent article; and surface finishing treatment of at least a portion of the bent article.

9. Method according to claim 1, comprising:

ovalizating the article during bending thereof; and sizing of the pipe.

10. A die for bending tubular articles with a relative ratio of the bending radius (R) and the outer diameter (D) of the finished article which is less than 3, comprising:

an asymmetrical bottom die half with a seat for the article; and a top die half having a punch asymmetrically arranged in a longitudinal direction with respect to a vertical center axis of the die;

wherein the top die half has a corresponding seat with dimensions corresponding to dimensions of a boss extending radially from the article and arranged adjacent to the said punch in the longitudinal direction so as to provide the initial contact between the top die half and the article along a section adjacent to a base of the boss.

11. A die according to claim 10, wherein the two die halves are ovalized along the section of the two die halves where the article is to be bent.

* * * * *